US006366031B2

(12) United States Patent
Klien

(10) Patent No.: US 6,366,031 B2
(45) Date of Patent: Apr. 2, 2002

(54) ELECTRONIC BALLAST FOR AT LEAST ONE LOW-PRESSURE DISCHARGE LAMP

(75) Inventor: Dietmar Klien, Mäder (AT)

(73) Assignee: Tridonic Bauelemente GmbH, Dornbirn (AT)

( * ) Notice: Subject to any disclaimer, the term of this patent is extended or adjusted under 35 U.S.C. 154(b) by 0 days.

(21) Appl. No.: 09/767,868

(22) Filed: Jan. 24, 2001

Related U.S. Application Data

(63) Continuation of application No. PCT/EP00/03573, filed on Apr. 19, 2000.

(30) Foreign Application Priority Data

May 25, 1999 (DE) ..... 199 23 945

(51) Int. Cl.[7] ..... G05F 1/00

(52) U.S. Cl. ..... 315/291; 315/274; 315/226; 315/209 R; 315/DIG. 7

(58) Field of Search ..... 315/209 R, 274, 315/278, 224–226, 291, 307, 177, 94, 101, 105, 106, DIG. 4, DIG. 7

(56) References Cited

U.S. PATENT DOCUMENTS 5,172,034 A * 12/1992 Brinkerhoff ..... 315/307
5,656,891 A 8/1997 Luger et al. ..... 315/94
5,854,538 A 12/1998 Krummel ..... 315/105
6,002,214 A * 12/1999 Ribarich ..... 315/307
6,140,771 A 10/2000 Luger et al. ..... 315/101

FOREIGN PATENT DOCUMENTS

| | | |
|---|---|---|
| DE | 29514817 U1 | 1/1996 |
| EP | 0 707 438 | 4/1996 |
| EP | 0 722 263 A1 | 7/1996 |
| EP | 0 748 146 A | 12/1996 |
| EP | 0 889 675 A | 1/1999 |

* cited by examiner

*Primary Examiner*—Haissa Philogene
(74) *Attorney, Agent, or Firm*—Fitzpatrick, Cella, Harper & Scinto

(57) ABSTRACT

An electronic ballast for a low-pressure discharge lamp (LA) contains an inverter that is fed with direct voltage ($U_{BUS}$) and the output of which is connected to a load circuit containing terminal contacts for the lamp (LA), a heating transformer that has a primary winding (Tp), which is connected to the output of the inverter, and a respective secondary winding (Ts1, Ts2), which is located in a heating circuit with a coil (W1, W2), for heating each of the two electrodes of the lamp (LA), and a series circuit arrangement that is connected in parallel with the load circuit and which contains the primary winding (Tp) of the heating transformer and an electronic switch arrangement (S3, S4). For the purpose of identifying the type of lamp and the state of the lamp, the currents in one of the two heating circuits and in the primary winding (Tp) of the heating transformer are measured and evaluated.

24 Claims, 3 Drawing Sheets

ELECTRONIC BALLAST FOR AT LEAST ONE LOW-PRESSURE DISCHARGE LAMP

CROSS REFERENCE TO RELATED APPLICATIONS

This is a Continuation of copending International Application No. PCT/EP00/03573 filed Apr. 19, 2000, which was published under PCT Article 21(2) on Nov. 30, 2000 in German but not in English.

BACKGROUND OF THE INVENTION

1. Field of the Invention

The present invention relates to an electronic ballast for the operation of at least one low-pressure discharge lamp.

2. Description of the Related Art

Usually, nowadays ballasts are used that supply a high-frequency alternating voltage to the gas discharge lamps or fluorescent tubes. Apart from the voltage supply, such electronic ballasts are used, moreover, to preheat the electrodes of the gas discharge lamps and to ignite and operate the lamps gently. With the aid thereof, the degree of efficiency of the lamps is increased, a longer service life is attained and operation with reduced lamp output (dimming) is also rendered possible.

In this connection, before the igniting voltage is applied to the discharge lamp, the electrodes or the coils of the lamp are as a rule preheated for a specific period of time, thereby attaining a comparatively gentle start of the lamp and thus a longer service life of the lamp. Preheating is effected with the aid of coil-heating that brings about a flow of current through the two coils. In a ballast that is known from EP 0 707 438 A3, for this a heating transformer is used, the primary winding of which transformer is connected to the output of an inverter and which transformer has two secondary windings which are each coupled to one of the two lamp coils. Before the ignition of the discharge lamp, a frequency is set for the alternating voltage supplied by the inverter, which frequency is varied in relation to the resonant frequency of the series resonant circuit in such a way that the voltage that is applied to the discharge lamp does not, first of all, bring about any ignition of the lamp. Meanwhile, a substantially constant current flows through the two secondary heating circuits with the lamp coils, whereby the latter are preheated. After a period of time that suffices for preheating, the frequency of the alternating voltage that is fed to the series resonant circuit is then shifted in the direction of the resonant frequency for so long until the thereby increasing voltage that is applied to the discharge lamp brings about ignition of the lamp. According to EP 0 748 146 A1 or DE 295 14 817 U1, by opening a switch that is connected in series with the primary winding, the coil-heating can be switched off after the lamp has been ignited in order to reduce power losses that would otherwise occur.

The demands on the electronic ballasts in this connection are becoming more and more extensive. Thus, for example, it is usual for a dimming operation to be provided for the gas discharge lamp as well. Dimming that is effected to a great extent would, however, result in the lamp electrodes cooling below their emission temperature and thus in premature ageing of the lamp. In order to counteract this effect, the electrodes of the gas discharge lamp also need to be heated to a certain degree during the operation in which ignition has already taken place. In particular, it is advantageous to set the heating of the electrodes as a function of the degree of dimming in such a way that the latter are heated all the more, the greater the lamp is dimmed, that is, the darker it is. In accordance with EP 0 707 438 A2, the heating of the electrodes is regulated during the dimming in that the switch that is connected in series with the primary winding is closed for a short time.

The ballast should in addition also take on a monitoring function monitoring the state of the lamp in order to be able to detect possible operational disturbances and introduce appropriate measures. An operational disturbance can, for example, exist if one of the two coils or even both is or are defective or if the lamp has been completely removed. In the case of the electronic ballast described in EP 0 707 438 A2, the voltage drop across a resistor that is connected in series with the primary winding of the transformer and thus the heating current are measured in order to detect whether there is a coil-break or whether the lamp has been removed from the arrangement.

The method that has just been mentioned provides information on the state of the lamp, but not on what type of lamp it is. Often lamps do not differ externally, yet have differing electrical parameters and different power consumption. If a lamp whose performance features do not suit the electronic ballast is used in error, activation errors can result. In comparatively simple cases this impairs the illumination, but in more serious cases it can also result in damage to the lamp. Such problems could be avoided by detecting the type of lamp before ignition in a short check measurement and introducing appropriate measures. This can mean that the lamp is not preheated and ignited if it is the wrong type or better still that activation is effected that corresponds to the performance features of the lamp.

Basing considerations on the prior art mentioned above, it is therefore an object of the present invention to specify an electronic ballast for operating a low-pressure gas discharge lamp that performs the functions which have just been described, that is, lamp-identification, detection of the state of the lamp and coil-heating with controllable output, with the least possible outlay in terms of material and circuitry.

This object is achieved by means of a ballast which has the features of the present invention. An important feature of the ballast is an evaluating circuit arrangement which, for the purpose of identifying the type and the state of the lamp, detects and evaluates the current flowing through the primary winding of the heating transformer and in addition also the current flowing through at least one of the two heating circuits. The type of lamp is then identified by measuring the current that flows by way of the lamp coil and which represents a suitable measure of the coil resistance. The coil resistance in turn is a characteristic feature for distinguishing between lamps that have the same appearance, but different performance features. The current through the primary winding, on the other hand, provides information on the state of the lamp. The transformer steps down the heating voltage at the primary winding towards the lamp to a great extent so that the levels of coil resistance, for their part, are stepped up towards the primary winding. The behaviour of the transformer therefore depends greatly upon whether the coils are intact or whether, for example, a coil is defective and thus the pertinent secondary heating circuit is interrupted.

Furthermore, it is an object of the invention to render possible optimum control of the heating current and thus of the coil-heating. This is achieved in accordance with more specific features of the invention in that the connection of the primary winding of the heating transformer to the output of the inverter is regulated by a bidirectional switch consisting of two switches, with the primary winding of the heating transformer and a coupling capacitor being arranged between the two switches. The bidirectional switch can be formed by means of two field-effect transistors that are connected in series and are orientated in opposition to each other and are preferably activated by means of a common pulse-width modulated signal, with the pulse duty factor of this signal determining the degree of heating. With the aid of this arrangement, temporary discharge of a coupling capacitor contained in the heating circuit is avoided and thus a symmetrical heating voltage is attained.

Further developments of the invention constitute subject matter of the subclaims. The resistance value of one of the two coils is used in order to determine the lamp type—as has already been mentioned. The latter is determined by way of the peak value of the so-called pin current. In order to identify a coil-break or removal of the lamp, the current at the primary winding and at the same time as well the pin current are measured and both currents are set in relation to each other. This method makes it possible to make a statement on the state of the lamp independently of possible voltage fluctuations. In this connection, it is preferably first examined whether an intact lamp is present and only subsequently is the lamp type determined. In order to increase the reliability of the determination of the lamp, the measurement can be carried out twice, once before and once after the preheating of the lamp. The resistance values thereby measured can be compared with internally stored reference values and can then be associated with known lamp types. Furthermore, before the start of the coil-preheating and the lamp-identification a short test can be carried out to determine whether the coils are also actually cold. in this way, misinterpretations in the identification of the lamp, which can occur after a short-term mains failure, can be avoided. The current-measurements are preferably effected in each case by measuring the voltage drops across two measuring resistors which are arranged in the heating circuit of the primary winding and in the secondary heating circuit of a lamp coil respectively.

In a further development of the invention, the electronic ballast is constructed in such a way that the coil-heating is activated and the frequency of the alternating voltage that is applied to the load circuit with the lamp is set as a function of the type of lamp previously determined. In order to set the coil-heating as a function of the degree of dimming of the lamp, it can be established that the lowering of the lamp current brought about by the dimming of the lamp is to be substantially compensated for by the heating current. The level of the rated value for the pin current, that is, for the sum of the lamp current and heating current, is, in this connection, determined by the electronic parameters of the lamp. Preferably as well after the ignition of the lamp, a check measurement is carried out at regular intervals in order to identify a coil-break that might possibly have occurred or to identify removal of the lamp.

The invention shall be explained in greater detail in the following with reference to the enclosed drawing in which:

DETAILED DESCRIPTION OF THE PREFERRED EMBODIMENT

Figure 1:
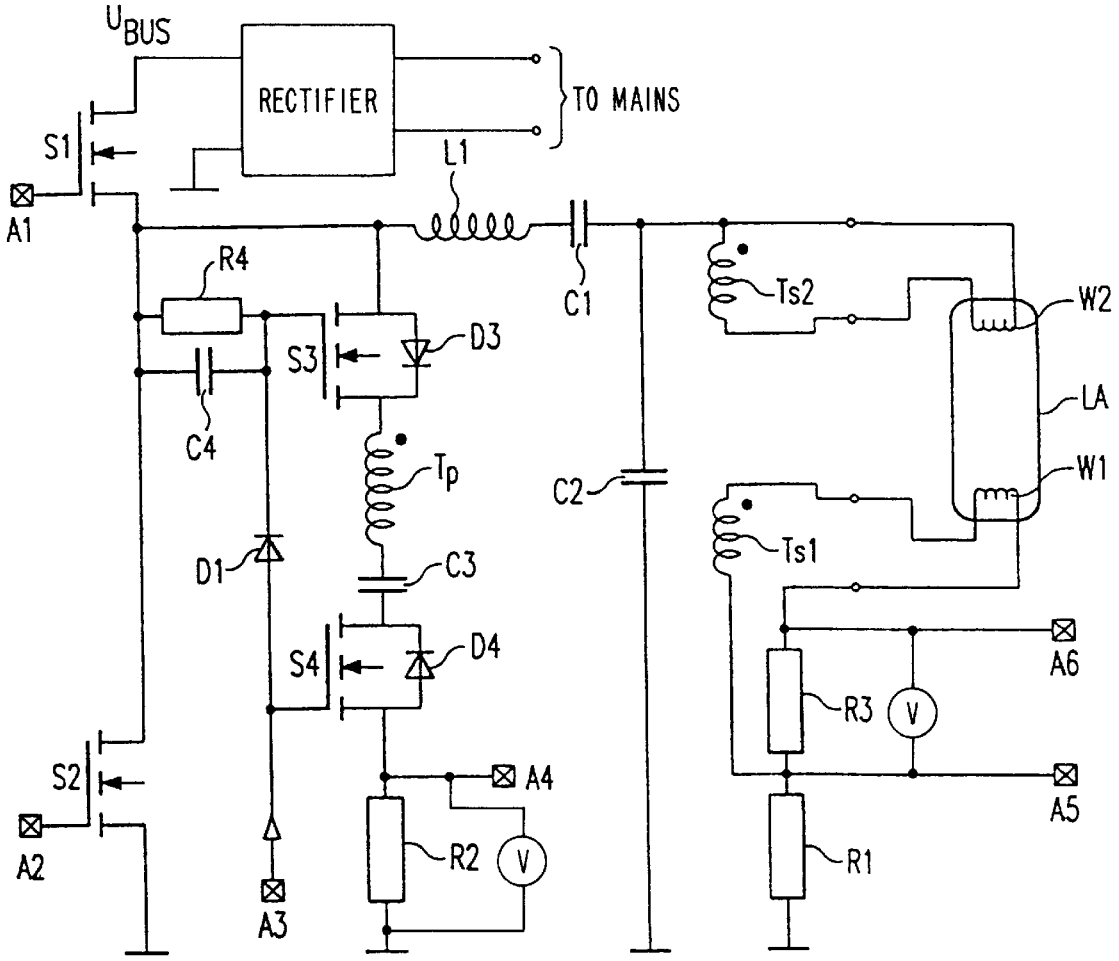
FIG. 1 shows the exemplary embodiment of a circuit arrangement in accordance with the invention.

In accordance with FIG. 1, the inverter of the ballast is formed by a half-bridge consisting of two electronic switches S1 and S2 which are connected in series, with each switch consisting of an MOS field-effect transistor. The two switches S1 and S2 are activated by way of two terminals A1 and A2 respectively that are connected to the gates of the transistors and which lead to a control/evaluating circuit arrangement which is not shown. The lower output of the half-bridge is connected to ground, whilst the direct voltage $U_{BUS}$, which can be generated, for example, by shaping the usual mains voltage by means of a combination of radio-interference suppressors and rectifiers, is applied to its input. As an alternative to this, however, any other direct-voltage source can also be applied to the input of the half-bridge.

The load circuit, which contains the discharge lamp LA, is connected to the output of the half-bridge, that is, to the common nodal point of the two switches S1 and S2. Said load circuit consists of a series resonant circuit which is composed of an inductance coil L1 and a resonant capacitor C2. Furthermore, a coupling capacitor C1 is arranged between the inductance coil L1 and the resonant capacitor C2. The upper cathode of the two cathodes of the low-pressure gas discharge lamp LA is connected to the connecting node between the two capacitors C1 and C2. The two cathodes of the lamp LA each have two terminals, provided between which there is a respective heating coil W1 and W2 for heating the cathodes. The lower cathode of the lamp LA is in turn connected to ground by way of two resistors R1 and R3 which are connected in series. The second terminal of the resonant capacitor C2 is likewise also connected to ground so that the lamp LA and the resonant capacitor C2 are connected in parallel with each other. The function of the second resistor R3 will be described further later.

For the purpose of heating the two coils W1 and W2, a heating transformer is provided that consists of a primary winding Tp and also of two secondary windings Ts1 and Ts2. The secondary windings Ts1 and Ts2 are each connected in a series circuit arrangement to a respective coil W1 and W2 of the lamp LA so that two separate secondary heating circuits are formed. The resistor R3 is arranged within the secondary heating circuit of the lower coil W1 so that both a lamp current flowing through the lamp LA and the heating current flowing through the lower coil W1 flow in the same direction through the measuring resistor R3. The primary winding Tp is a component part of a series circuit arrangement which additionally has a coupling capacitor C3 and two controllable switches S3 and S4 between which the primary winding Tp and the coupling capacitor C3 are arranged. At its lower end this series circuit arrangement is connected to ground by way of a further resistor R2 and at its upper end it is connected to the common nodal point of the two switches S1 and S2 of the half-bridge so that it is connected in parallel with the load circuit and the lower branch of the half-bridge. The two switches S3 and S4 also each consist of a field-effect transistor, yet—as can be inferred from FIG. 1—are orientated in opposition to each other so that a bidirectional switch is formed. Furthermore, the two free-wheeling diodes D3 and D4 of the two transistors S3 and S4 are shown in the circuit diagram.

The gates of the two switches S3 and S4 are activated by means of the control/evaluating circuit arrangement by means of a pulse-width modulated signal by way of the terminal A3. Located between the two gates, furthermore, there is a diode D1. The common nodal point between the output of the diode D1 and the gate terminal of the switch S3 is connected, by way of a capacitor C4 and a resistor R4 connected in parallel with this capacitor C4, to the common nodal point of the two switches S1 and S2 of the half-bridge. Finally, the circuit arrangement has three outputs A4, A5 and A6 that are connected to the control/evaluating circuit arrangement and which are used to measure the voltage drops across the resistors R2 and R3.

The measurement signals at the outputs A4, A5 and A6 are used to identify the type of lamp and to detect the state of the Lamp, that is, to check whether it is intact or whether possibly one of the two coils is broken. On the other side, the control/evaluating circuit arrangement, by means of the clock signals at the terminals A1 and A2, regulates the alternating voltage, which is fed to the load circuit, and, by means of the pulse-width modulated signal at the terminal A3, regulates the heating of the coils W1 and W2.

In the following, firstly the function of the bidirectional switch formed from the two field-effect transistors S3 and S4 for heating the coils W1 and W2 and the activation of the lamp LA shall be explained in greater detail.

Figure 2:
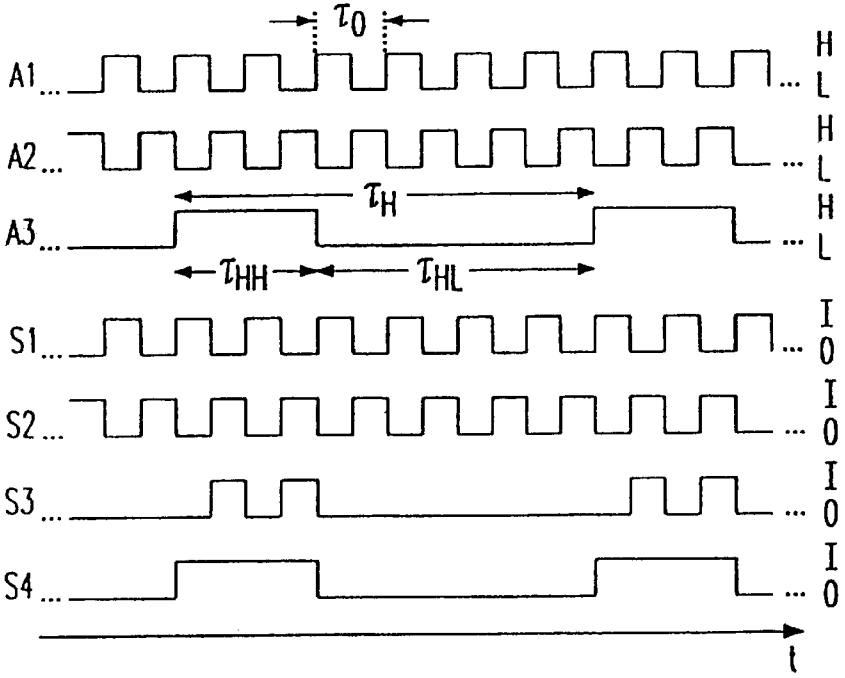
FIG. 2 shows a timing diagram of the control signals and the pertinent states of the switches during the normal/dimming operation of the lamp.

FIG. 2 shows a typical timing diagram of the control signals that are applied to the three inputs A1, A2 and A3 and also the resultant state of the four switches S1 to S4 for an operating state of the lamp LA in which ignition has already taken place and there is slight dimming. In this connection, regularly alternating signals are applied to the terminals A1 and A2 of the two half-bridge switches S1 and S2 between a high level H and a low level L in such a way that in each case one of the two switches S1 or S2 is opened (I) and the other is closed (0). At the centre point of the half-bridge in this way a high-frequency alternating voltage that has the period length $t_0$ or the frequency $1/t_0$ is generated and fed to the load circuit. The degree of dimming of the gas discharge lamp is substantially determined by the deviation of the frequency $1/t_0$ of the alternating voltage from the resonant frequency of the load circuit. A large deviation in this connection signifies a high level of dimming.

In the example shown in FIG. 2 it may be assumed that the selected period length to actually gives rise to a certain dimming of the lamp. In order to counteract premature ageing of the lamp, the two electrodes must be heated by an additional heating current so that they continue to be kept at their emission temperature. The heating is effected by low-frequency connection of the primary heating circuit to the centre point of the half-bridge at regular intervals $t_H$ and for a predetermined period of time $t_{HH}$. In these heating phases $t_{HH}$ the capacitor C3 then decouples the direct-voltage component so that a symmetrical square-wave voltage with a peak value of $U_{BUS}2$ is produced in the primary winding Tp of the heating transformer. Even during a comparatively long off-phase $t_{HL}$ of the heating transformer, the coupling capacitor C3 should not be discharged so that a symmetrical voltage signal can be generated at the primary winding Tp at any time. This is important in particular in such cases in which a multi-lamp unit is formed, in which unit the peak value of the primary voltage need barely be applied to the transverse discharge voltage of the low-resistance coils. If the heating circuit were connected to the centre point of the half-bridge just with the aid of one single switch (for example just by means of the lower transistor S4), the coupling capacitor C3 would, however, be discharged by way of the internal free-wheeling diode D4 of this transistor during the periods in which the lower switch S2 of the half-bridge is closed.

In the present exemplary embodiment therefore a bidirectional switch is formed from the two field-effect transistors S3 and S4, with the gates of the two transistors S3 and S4 being activated by means of the common pulse-width modulated signal A3. The mode of functioning of this bidirectional switch can also be inferred from the curves in FIG. 2. If the signal A3 has a low level L, both switches S3 and S4 are opened and the coil-heating is switched off. If the control signal A3 changes to a high level H at the beginning of a heating pulse $t_{HH}$, the lower transistor switches through and switch S4 is thereby closed (I). However, as long as the upper switch S1 of the half-bridge is also closed (I), the transistor S3 still remains blocked and the second switch S3 is open (0). In this phase, current then flows by way of the internal free-wheeling diode D3 of this transistor S3, whereby the coupling capacitor C3 is charged. If the clock pulse of the half-bridge changes, that is, switch S1 closes (0) and switch S2 opens (I), the source potential of the transistor S3 connects to ground and the switch S3 also closes (I). The coupling capacitor C3 can then be discharged and supply its energy again.

In order to switch off the heating phase $t_{HH}$, the PWM-signal A3 is switched to a low level and the transistor S4 is thereby blocked. The gate of the transistor S3 is then no longer activated by way of the diode D1 and the transistor S3 is now kept blocked, in a passive manner, by way of the resistor R4. The additional capacitor C4 guarantees that the transistor S3 is not switched on unintentionally during the off-phase $t_{HL}$ on account of the Miller capacitance. During this period of time $t_{HL}$, both switches S3 and S4 are consequently open and any discharge of the coupling capacitor C3 by way of one of the two free-wheeling diodes D3 or D4 is also precluded. In this way, consequently at regular intervals $t_H$ or with the frequency $1/t_H$ for a predetermined period of time $t_{HH}$ an alternating voltage with the frequency $1/t_0$ supplied by the inverter is generated in the primary winding Tp of the heating transformer and in the secondary heating circuits of the two lamp coils W1 and W2. The bidirectional switch is of course not restricted to use in the ballast that is described here, but can in principle be used in the case of a heating transformer and a coupling capacitor connected therewith, with a substantial improvement in the control of the heating current being attained thereby in each case.

The period length $t_H$ of the signal A3 is then substantially longer than the period length $t_0$ of the high-frequency clock signals A1 and A2. The choice of the low frequency $1/t_H$ is dependent upon a plurality of considerations. On the one hand, not too high a frequency $1/t_H$ or not too short a period $t_H$ should be selected, since otherwise too coarse a gradation of the heat output results. Since the connection of the heating circuit has an effect upon the light output of the lamp, signs of flickering can then result. On the other hand, the selected frequency $1/t_H$ may not be too low either, since otherwise the two coils W1 and W2 cool too much during the off-phase $t_{HL}$, something which can have a negative effect upon the service life of the lamp LA. The selected frequency $1/t_H$ of the pulse-width modulated signal A3 should therefore be such in each case that a substantially constant electrode temperature sets in.

The effective value of the heating voltage and thus the degree of the heat output are determined by the pulse duty factor of the pulse-width modulated signal A3 and by the relationship over time between the high phase $t_{HH}$ and the low phase $t_{HL}$. Said value is preferably set in accordance with the degree of dimming and the type of lamp LA. The corresponding method for setting the heat output will be explained further below. If the lamp LA, which has already ignited, is operated close to the resonant frequency of the load circuit and thus with almost maximum output, the coil-heating can be switched off completely in order to reduce power losses. The service life of the lamp LA is not substantially impaired thereby, since the operating temperature of the electrodes is sufficient in this case. In contrast with this, during the preheating of the coils W1 and W2 a comparatively high heat output is selected in order to make it possible for there to be a short preheating time and rapid ignition of the lamp LA. During the preheating, the half-bridge is operated further at a very high frequency $1/t_0$ of almost 120 kHz. Since this frequency lies well above the resonant frequency of the load circuit, premature and unintentional ignition is avoided.

The process of igniting the lamp LA is carried out in a known manner. If no malfunctions have been identified during the detection of the state of the lamp that is still to be explained in greater detail and during the identification of the lamp, at the end of a predetermined heating time the frequency of the alternating voltage supplied by the half-bridge is lowered and approximated to the resonant frequency of the load circuit. As a result, the voltage that is applied to the lamp LA is increased until ignition is finally effected. A simple method for regulating the heat output as a function of the degree of dimming of the lamp LA, shall now be explained in brief. This method consists in controlling the current that flows off from the lower coil W1. This so-called pin current is composed of two components, on the one hand of the lamp current that flows by way of the ignited lamp LA and, on the other hand, of the mean heating current that is generated by the heating transformer. The aim now is to keep this pin current substantially at a predetermined rated value or within a predetermined range. If the lamp LA is namely dimmed by changing the alternating voltage frequency, the lamp current and the electrode temperature are reduced as a result. A measure for the additional heating of the electrodes can now be selected, for example, in such a way that the current reduction brought about by the dimming is to be compensated for again by the heating current. The control/evaluating circuit arrangement is therefore preferably formed in such a way that it measures the pin current and modulates the pulse width of the control signal at the terminal A3 in an appropriate manner. The current is thereby measured by briefly measuring the voltage drop across the measuring resistor R3 by means of a voltmeter (not shown) that is connected to the outputs A5 and A6 and which is a component part of the control/evaluating circuit arrangement or routes the measurement result on to the latter.

The value that is predetermined for the pin current is determined by inter alia the type and the power consumption of the lamp LA. In this connection, the electronic ballast is formed in such a way that it independently identifies the type of lamp with its specific electrical parameters (for example preheating current, lamp current, lamp output), and the activation of the lamp LA and the coil-heating by way of the signals A1, A2 and A3 is then effected in an appropriate manner. Since lamps that have different parameters externally often only differ very little or not at all, by means of automatic identification of the lamp at the same time as well it is possible to avoid activation errors that can result in unsatisfactory light efficiency or even in damage.

In the case of the ballast in accordance with the invention, the lamp is identified by measuring the resistance of one of the two coils. This coil resistance is a feature that suffices to distinguish between lamps which fit into a common socket, but have different performance parameters. With knowledge of the supply voltage that is fed to the inverter, the simplest possibility of determining the coil resistance consists in measuring the peak value of the pin current which, in the case of the circuit arrangement shown in FIG. 1, is also detected by means of the voltage drop across the measuring resistor R3, by way of the outputs A5 and A6. The coil resistance is preferably measured at the beginning and at the end of the preheating phase. Since during the preheating—that is, before the lamp LA is ignited—lamp current does not yet flow, in this case it is also possible to measure the voltage drop between the terminal A6 and ground. During the identification of the lamp, a comparatively low heat output (approximately 5% pulse duty factor) is set in order to avoid excessive heating of the coils W1, W2. The half-bridge at this time runs at a high frequency of approximately 120 kHz.

The pin current is preferably measured, and possibly averaged, in each case at the end of the switch-on phase of the upper switch S1 of the half-bridge. The peak values which are measured are then in each case compared with a stored reference value, and the type of lamp is ascertained with the aid of the result of the comparison. For each lamp type, consequently, two resistance reference values are required, one for the cold coils W1, W2 and one for the preheated coils W1, W2. It is to be noted in this connection that the pin current is not only dependent upon the coil resistance, but also upon the coil voltage and thus upon the bus voltage UBuS that is fed to the inverter. In order to avoid possible fluctuations and measurement errors, the identification of the coil is therefore not carried out until after the system has settled and until after the bus voltage $U_{BUS}$ has stabilized. As an alternative to this, however, the bus voltage $U_{BUS}$ could be determined in a separate measurement and the voltage drop across the measuring resistor R3 could be set in relation thereto, for example by forming the differential voltage. In this way, it would even be possible to carry out the identification of the lamp independently of such fluctuations.

A further misinterpretation in the determination of the lamp can occur if the mains voltage supplying the electronic ballast fails for a short time or is briefly switched off and back on. In each case, this is interpreted by a ballast as a restart of the lamp LA and consequently preheating and identification of the lamp are carried out one more time. However, the coils W1, W2 in this case are not yet cooled and accordingly have a different resistance. The identification of the lamp then leads to an incorrect result. In order to make allowances for this possibility, before the resistance is determined it is examined whether the coil W1, W2 is hot or cold. If the coil W1, W2 is actually still hot, the lamp LA is deliberately preheated with a somewhat lower heat output, and identification of the lamp is only carried out on the basis of the resistance measurement at the end of the preheating phase. The somewhat different form of preheating can be tolerated in this connection since this case only seldom occurs. The distinction between a hot and a cold coil W1, W2 is made by way of a measurement of the change in the coil resistance within a predetermined short time span of, for example, 10 ms. If the change is negative, it is assumed that the coil W1, W2 is hot or warm and the preheating is carried out at a reduced level. If, on the other hand, no change can be ascertained, this is seen to indicate the presence of a cold coil W1, W2 and therefore the usual preheating and determination of the lamp are carried out. This check measurement is also carried out by means of two short scans of the pin current or of the voltage drop across the measuring resistor R3, with it being possible to assess the level of the change in resistance, for example, with the aid of a Schmitt trigger. Since the coil resistance is also measured in these scans, the two check measurements also simultaneously represent the first resistance measurement for the identification of the lamp.

Before the identification of the lamp and the preheating of the coils W1 and W2 connected therewith are carried out, however, it is further examined whether a lamp LA is actually located in the system and whether as well this is intact. For this purpose, the peak value of the pin current is measured and compared with the peak value of the primary current of the heating transformer. The pin current, just as in the case of the control of the coil-heating and as in the case of the identification of the lamp, is determined by way of the voltage drop across the measuring resistor R3. The current flowing through the primary winding Tp of the heating transformer, on the other hand, is determined by the voltage drop across the resistor R2. For this reason, the output A4 that is connected to the control/evaluating circuit arrangement is provided between the switch S4 and the measuring resistor R2. Just as in the case of the identification of the lamp, during this measurement the half-bridge is operated with the highest possible frequency of approximately 120 kHz in order to keep the voltage that is fed to the lamp LA as low as possible and to avoid premature ignition. A low pulse duty factor of the pulse-width modulated control signal is also set at the terminal A3 so that the two coils W1 and W2 are not heated too much. Since a current that flows by way of the primary winding Tp is to be measured, a measuring instant is selected at which a high level H is applied to the terminal A3 and the coupling capacitor C3 is charged. As in the case of the identification of the lamp, this measurement is therefore also carried out shortly before the end of the switch-on phase of the upper switch S1 of the half-bridge.

If both coils W1 and W2 of the lamp LA are intact, the following relationship applies to the peak values of two measured currents:

$$I_{R2}=I_{R3}\cdot n\cdot 1/\ddot{u}$$

ü then denotes the transformation ratio and n the number of intact coils W1, W2. The transformation ratio ü of the heating transformer follows from the maximum coil voltage. It should be ensured that this ratio ü does not become too large, since otherwise the capacitive currents with preheating switched off give rise to excessive coil losses during the operation. In order to evaluate the state of the lamp, the primary current $I_{R2}$ is then set in relation to the pin current divided by the transformation ratio $I_{R3}\cdot 1/\ddot{u}$ and the result that theoretically produces the number of coils n is evaluated. In the simplest way, this is effected by comparing the result with a reference value. If, for example, a value that is smaller than 1.3 results, in all probability there is a coil-break. Since current still flows through the lower secondary heating circuit of the coil W1, accordingly the upper coil W2 must be defective. If, on the other hand, no current at all flows through the measuring resistor R3, either the lower coil W1 is defective or no lamp LA at all is present. In this way, it is consequently possible to detect the possible states of the lamp in a simple and rapid manner.

A further advantage of this method can be seen in the fact that a statement on the state of the lamp is thereby obtained that is independent of possible fluctuations in the supply voltage $U_{BUS}$. Whilst a fluctuation in $U_{BUS}$ affects the result of measurement of the pin current, the primary heating current is also changed likewise. It is not absolutely necessary to wait until after the system has settled and the supply voltage $U_{BUS}$ has stabilized. Furthermore, the influence of possible coil resistance tolerances is also reduced. In the same way, during the normal operation of the lamp LA it is also possible to check the state of the lamp at regular intervals in order to detect a coil-break that occurs in the meantime. For this purpose, however, the lamp current should not affect the heating current too much, for example it should not amount to more than 10% of the pin current. If a coil-break occurs whilst the lamp is in operation or if the lamp is removed, this check measurement can be carried out repeatedly until an intact lamp is identified in the system again. A restart can then be initiated automatically.

Figure 3:
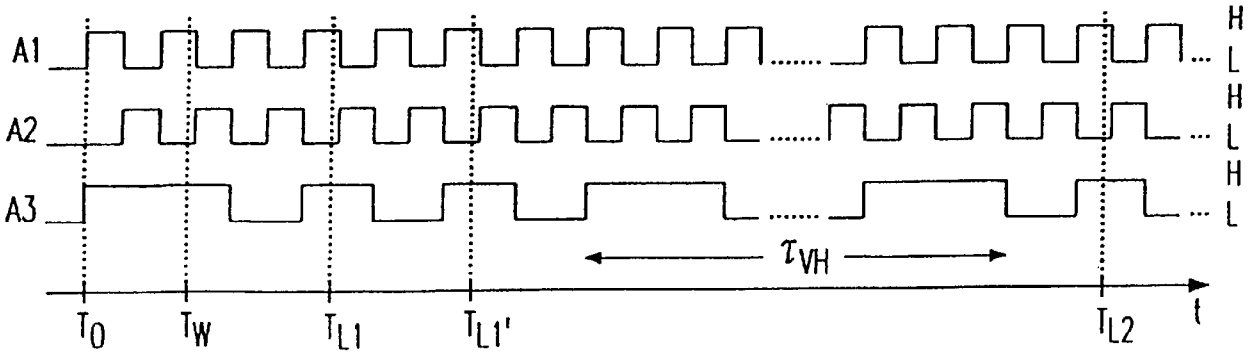
FIG. 3 shows a timing diagram of the control signals before the ignition of the lamp.

A possible temporal sequence of these measurements which have just been described for the identification of the lamp and for the detection of the state of the lamp is shown Ln the timing diagram in FIG. 3. The start of the lamp occurs at instant $T_0$. It may be assumed here that at this instant $T_0$ the system has already settled and the supply voltage $U_{BUS}$ has stabilized. Immediately after the start of the lamp, in the first place the check measurement is effected to determine whether an intact lamp is inserted or whether possibly there is a coil-break. Since here the pin current at the resistor R3 is compared with the primary current of the coil-heating at the resistor R2, this measurement must be carried out at an instant $T_w$ at which the control signals at the terminals A1 and A3 lie at a high level H. As has already been said, all the measurements are preferably carried out shortly before the signals A1 and A2 change. Furthermore, a frequency of almost 120 kHz is selected for these signals.

If an intact lamp has been identified, subsequently two measurements of the coil resistance are carried out shortly one after the other at the instants $T_{L1}$ and $T_{L1N}$ in order to ascertain whether the coils W1, W2 are warm or cold. Since in this connection variations in temperature or changes in resistance are to be observed, during this time a low pulse duty factor is selected for the control signal at the terminal A3. The spacing between $T_{L1}$ and $T_{L1N}$ amounts to approximately 10 ms.

Subsequently, in the period of time $t_{VH}$ the coils W1, W2 are preheated, with the heat output occurring in accordance with the state of the coils W1, W2, that is, for example a higher heat output is set if the resistance measured at the later instant $T_{L1N}$ is not lower than the resistance value measured at the instant $T_{L1}$. After the preheating time, at the instant $T_{L2}$ the coil resistance is measured again and then with the aid of the measurement results at the time $T_{L1}$, $T_{L1N}$, and $T_{L2}$ the type of lamp is determined. If the coils W1, W2 were warm, only the result of the third measurement is taken into consideration; if the coils were cold, all three measurements can be used for the determination of the lamp. Subsequently, the ignition of the lamp LA, which is not further represented, is initiated.

Figure 4:
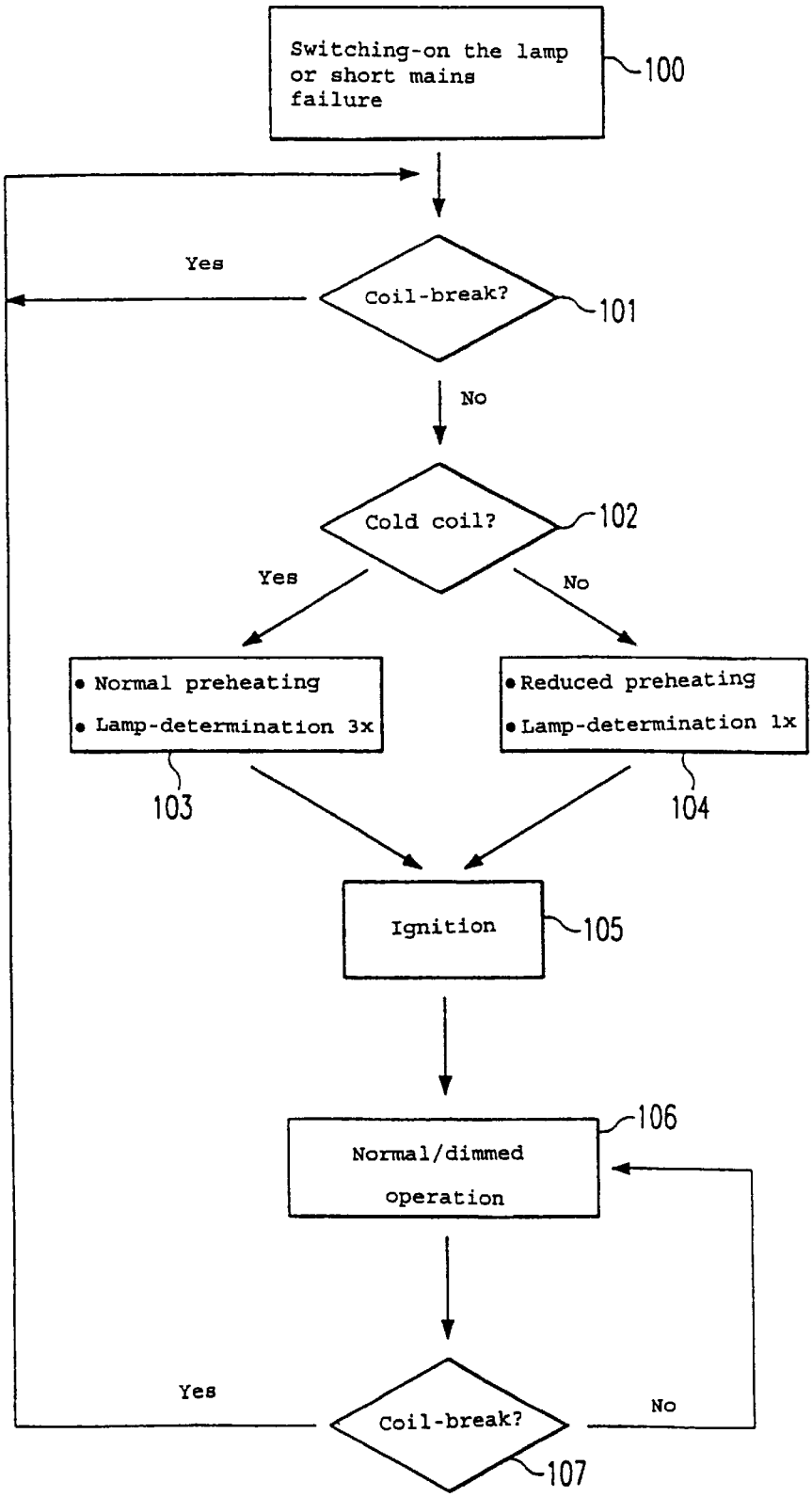
FIG. 4 shows a possible flow chart of the different operating phases of the lamp.

A summary of the functions of the electronic ballast in accordance with the invention that have been outlined is presented in FIG. 4. This shows a simplified flow chart of the individual phases during the operation of the lamp. After switching on the mains voltage or a short mains failure 100, in the first place in the manner that has just been described the query 101 is put in order to determine whether there is a coil-break. If this is the case or if there is no lamp at all in the system, the query 101 is repeated continuously until finally an intact lamp is identified.

If an intact lamp has been identified, in the next step 102 it is checked, by means of the two pin-current measurements carried out shortly one after the other, whether the coils are cold. If the coils are actually cold, the lamp is preheated in the normal manner and the identification of the lamp is carried out on the basis of the measurement results before and after the preheating phase 103. If a warm coil has been identified instead, only a reduced level of preheating 104 is carried out and the type of lamp is determined at the end. After preheating 103 or 104 respectively, finally the lamp is ignited 105, with the four switches being activated as a function of the lamp type that has been identified.

After the ignition 105, the system operates in normal or dimmed operation 106, as an alternating-voltage frequency, corresponding to the type of lamp and the desired degree of dimming, and heat output are set by the control/evaluating circuit arrangement. During this phase, in addition at regular intervals once more a query 107 is put to determine whether a coil-break has possibly occurred or whether the lamp has been removed. If this is the case, the normal/dimming operation is brought to an end and the system is reset to the state of the original coil-break query 101. It would, however, also be conceivable to switch off the inverter upon identification of a coil-break or another defect of the lamp. It would then be possible to monitor, with the aid of a suitable circuit arrangement, whether the defective lamp has been replaced by a new one. If, finally, an intact lamp is identified in the system again, a restart can be initiated automatically. If no change in the state of the lamp is ascertained in the check measurement 107, the lamp is activated for so long in normal/dimming operation until it is finally switched off. In this connection, the flow chart in FIG. 4 only shows one possibility of the sequence of the various check measurements and phases of the lamp. Of course, very many other control methods in which the various measurements take place at different instants, would also be possible.

Consequently, all in all in order to control the lamp in the manner that has just been described, current measurements at two different points in the circuit arrangement (in one of the two secondary coil-heating circuits and in the primary heating circuit) as well as a controllable switch arrangement for the connection of the primary heating circuit are required. The material outlay for such an extension is then comparatively small. It follows from the descriptions of the various detection measurements that, instead of the voltage measurements at the two measuring resistors R2 and P3, other current-measuring methods can also be used, since for the purposes of lamp-identification and detection of a coil-break only the respective current intensities need to be determined. Moreover, the arrangements that are shown for the measuring resistors R2 and R3 are not prescribed absolutely. For example, the measuring resistor R2 can also be located between the two switches S3 and S4. It is also possible to measure the pin current as well in the heating circuit of the upper coil W2 and thus measure the coil resistance of the upper coil W2.

What is claimed is:

1. An electronic ballast for at least one low-pressure discharge lamp comprising:

an inverter arranged to be supplied with direct voltage and having an output which is connected to a load circuit containing terminal contacts for a lamp;

a heating transformer having a primary winding, which is connected to said output of said inverter, a secondary winding of said heating transformer being connected in a heating circuit together with a coil for heating electrodes of a lamp;

a series circuit connected in parallel with said load circuit, said series circuit including said primary winding of said heating transformer and electronic switch;

an evaluating circuit connected to measure current flowing through said series circuit including said primary winding and said electronic switch; and said evaluating circuit being connected to additionally measure current flowing through said heating circuit and to evaluate the amplitude or the time characteristic of the measured current in order to identify the type of lamp and the state of the lamp.

2. The electronic ballast according to claim 1, wherein:

for the purpose of measuring current through said series circuit arrangement including said primary winding and said electronic switch connected in series with said primary winding, a first measuring resistor is connected to pass said current to generate a corresponding voltage; and wherein said evaluating circuit is arranged to evaluate said corresponding voltage which is generated across said first measuring resistor by the current which flows through said first measuring resistor.

3. The electronic ballast according to claim 1, wherein:

for the purpose of measuring current through said heating circuit, said heating circuit is provided with a second measuring resistor, and in that voltage drops across this second measuring resistor which are generated by current flowing therethrough are fed to said evaluating circuit.

4. The electronic ballast according to claim 3, wherein:

said second measuring resistor is arranged in said heating circuit in such a way that lamp current flowing through a lamp, after such lamp has been ignited, flows in the same direction in which a heating current that is generated by said heating transformer flows through the second measuring resistor.

5. The electronic ballast according to claim 1, wherein:

said electronic switch is formed by two field-effect transistors which are arranged in opposition to each other; and wherein said primary winding of said heating transformer and a coupling capacitor connected in series therewith, are connected between said two field-effect transistors.

6. The electronic ballast according to claim 5, wherein:

said two field-effect transistors have gates that are activated by a common pulse-width modulated signal.

7. The electronic ballast according to claim 4, wherein:

said electronic switch arrangement is formed by two field-effect transistors which are arranged in opposition to each other; and wherein said primary winding of the heating transformer and a coupling capacitor connected in series therewith are connected between said two field-effect transistors, whereby after ignition of a lamp connected in said load circuit, a pulse duty factor is set for a pulse width modulated signal and the gates of the two field-effect transistors are activated jointly, in such a way that the current flowing through said second measuring resistor is substantially equal to a rated value.

8. The electronic ballast according to claim 7, wherein:

said rated value is established according to the type of lamp detected by the evaluating circuit arrangement.

9. The electronic ballast according to claim 1, wherein:

said inverter includes a half-bridge comprising two electronic switches that are connected in series and which are alternately opened and closed; and wherein said load circuit, and the series circuit arrangement, comprising said primary winding and said electronic switch arrangement, are connected in parallel with one of said two electronic switches.

10. The electronic ballast according to claim 9, wherein:

said electronic switch is formed by two field-effect transistors which are oriented in opposition to each other; wherein said primary winding of the heating transformer, and a coupling capacitor connected in series therewith, are connected between said field-effect transistors; wherein a diode is connected between the gates of said field-effect transistors; and wherein the gate of one of the two field-effect transistors is connected to the output of the inverter by way of a resistor.

11. The electronic ballast according to claim 10, wherein:

a further capacitor is connected in parallel with said resistor.

12. The electronic ballast according to claim 1, wherein:

said ballast includes a rectifier that is connectable to a main to generate a direct voltage, said direct voltage being fed to the inverter.

13. The electronic ballast according to claim 1, wherein:

said load circuit includes an inductance coil which is connectable in series with a lamp, and a resonant capacitor which is connectable in parallel with such lamp.

14. The electronic ballast according to claim 1, wherein:

for the purpose of identifying a type of the lamp, a current measuring device is provided to measure and evaluate current that flows through said heating circuit and which is dependent upon a respective coil resistance.

15. The electronic ballast according to claim 14, wherein:

for the purpose of identifying a type of lamp, said evaluating circuit arrangement is connected to compare the peak value of current measured in said heating circuit, with a reference value.

16. The electronic ballast according to claim 14, wherein:

a measurement device is arranged to identify a lamp type at the beginning and at the end of a preheating phase of such lamp.

17. The electronic ballast according to claim 16, wherein:

said evaluating circuit arrangement is connected to carry out a check measurement for distinguishing between a warm and a cold coil before a lamp preheating phase by comparing amplitudes or peak values of two currents, measured one after the other, through said heating circuit.

18. The electronic ballast according to claim 17, wherein:

said evaluating circuit arrangement is arranged such that only the result of the measurement at a end of a lamp preheating phase is used to identify a type of lamp where a warm coil has been identified in a check measurement.

19. The electronic ballast according to claim 1, wherein:

said evaluating circuit arrangement is connected, for the purpose of identifying a change of lamp or lamp defect to evaluate simultaneously, measured peak values of currents through said series circuit arrangement with said primary winding and said electronic switch and also through said heating circuit.

20. The electronic ballast according to claim 19, wherein:

said evaluating circuit is connected to set said simultaneously measured peak values in relation to each other and to evaluate the result.

21. The electronic ballast according to claim 19, wherein:

a measurement device is connected to effect a measurement in order to identify a change of lamp or a lamp defect immediately after the ballast has been switched on.

22. The electronic ballast according to claim 19, wherein:

a measurement device is connected to carry out a measurement at regular intervals after ignition of a lamp to identify a change of lamp or a lamp defect.

23. An electronic ballast for a low-pressure discharge lamp comprising:

an inverter that is arranged to receive a direct voltage, said inverter having an output which is connected to a load circuit having terminal contacts for a lamp;

a heating transformer having a primary winding connected to said output of said inverter, said transformer having at least one secondary winding which is located in a heating circuit with a coil for heating each of two electrodes of such lamp; and a series circuit arrangement connected in parallel with said load circuit, said series circuit arrangement including said primary winding of said heating transformer and further including a first switch, said series circuit arrangement, with said primary winding and said first switch, further including a coupling capacitor and a second switch, with said primary winding and said coupling capacitor being arranged between said two switches.

24. The electronic ballast according to claim 23, wherein:

said switches are formed by field-effect transistors which are orientated in opposition to each other.

* * * * *